United States Patent [19]

Ruppert et al.

[11] Patent Number: 4,887,617

[45] Date of Patent: Dec. 19, 1989

[54] TOBACCO PRODUCT FOR THE PERSONAL PREPARATION OF A CIGARETTE, IN PARTICULAR FILTER CIGARETTE

[75] Inventors: Heinrich W. Ruppert; Klaus G. Gätschmann, both of Trossingen, Fed. Rep. of Germany

[73] Assignee: EFKA-Werke Fritz Kiehn GmbH, Fed. Rep. of Germany

[21] Appl. No.: 136,901

[22] Filed: Dec. 21, 1987

[30] Foreign Application Priority Data

Dec. 22, 1986 [DE] Fed. Rep. of Germany ..... 3644047
Jan. 8, 1987 [DE] Fed. Rep. of Germany ..... 3700420

[51] Int. Cl.[4] ..... A24C 5/00
[52] U.S. Cl. ..... 131/70; 131/365
[58] Field of Search ..... 131/70, 71, 72, 75, 131/76, 360, 365

[56] References Cited

U.S. PATENT DOCUMENTS 3,927,681 12/1975 Bramhill ..... 131/70

*Primary Examiner*—V. Milin
*Assistant Examiner*—J. Welsh
*Attorney, Agent, or Firm*—Andrus, Seales, Starke & Sawall

[57] ABSTRACT

A tobacco product for the personal preparation of a cigarette, in particular a filter cigarette, includes an inherently stale tobacco portion (10) corresponding to the tobacco filling of a finished cigarette. The surface of the tobacco portion is defined by a wrapping or sheath (13), which consists of completely smokeable material. The sheath is permeable to air and the tobacco portion can only be smoked after tight wrapping of the sheath 13 with cigarette paper. The diameter of the tobacco portion (10) is smaller—preferably only slightly—than the inner diameter of the wrapping of cigarette paper or the like such as a preformed cigarette paper sleeve (11) for easy insertion of the tobacco portion (10) into the sleeve. In order to ensure that the tobacco portion (10) bears tightly within the cigarette paper, the tobacco portion (10) is responsive to heating to expand and tightly engages the cigarette paper and at least in the region of the glowing area (17). The tobacco is preferably an automatically expanding smoking material which automatically increases in volume in response to smoking of the material. Various structures such as surface projections are provided for closing any gap between the tobacco portion (10) and the cigarette paper.

15 Claims, 3 Drawing Sheets

TOBACCO PRODUCT FOR THE PERSONAL PREPARATION OF A CIGARETTE, IN PARTICULAR FILTER CIGARETTE

BACKGROUND OF THE PRESENT INVENTION

The invention relates to a tobacco product for the personal preparation of a cigarette, in particular a filter cigarette, and to a method for the personal preparation of a cigarette, in particular a filter cigarette, using a tobacco product of this type.

The production of cigarettes by the consumer has been known in many forms for a long time. This is true above all for so-called "roll-your-own" cigarettes using small pieces of cigarette paper provided with an adhesive edge. Rolling one's own cigarettes requires a certain manual dexterity and a certain consumption of time. Even with persons practised in rolling their own cigarettes, the cigarettes vary considerably as regards to size (diameter). firmness (roundness) and degree of filling over the length of the cigarette and form solely a primitive substitute for industrially produced cigarettes. The inevitable crumbling of tobacco is also a drawback, the tobacco yield suffering thereby. These same problems occur—even if to a lesser extent—when using self-rolling appliances.

The same is true for the other basic type of individual production of cigarettes, namely the individual filling of cigarettes. A series of more or less convenient appliances exists for filling empty cigarette sleeves (normally with a filter member) with tobacco, an elongated pressing chamber is common to all the conventional appliances, which chamber is defined on one side by an approximately hemispherical, stationary wall portion and on the other side by an inversely hemispherical surface of a movable pressing beam which can close the pressing chamber after filling with tobacco, thus producing a rod-like tobacco supply. One end face of the pressing chamber includes mounting socket for applying and mounting an empty cigarette sleeve. At the opposite end, the pressing chamber is defined by a piston-like tobacco ejection slide, by means of which the supply of tobacco can be transferred from the pressing chamber into the cigarette sleeve. These known filling appliances have proved more or less satisfactory in practice. They nevertheless have the drawback that the prime costs for the initial equipment are relatively high on account of the partially quite complicated constructions for operating the ejection slide, so that in this respect a certain inhibiting threshold must be overcome by the consumer. Furthermore, when filling the pressing chamber, a certain contamination of the user's hands and of the surrounding area with tobacco residues or crumbs cannot be avoided, which is partly felt to be troublesome and frequently deters the user from using the same. Finally, a degree of filling of the pressing chamber and thus of the cigarette sleeve which is always constant, is not possible with manual filling. Cigarettes filled in this way are characterized by variable smoking performance, namely a varying suction, taste and different length of smoking duration. In this respect, the personally filled cigarettes behave in the same way as the personally rolled cigarette. Also, the content of harmful substances in the cigarette personally filled or personally rolled in a conventional manner varies greatly and uncontrollably according to the various degrees of filling of the cigarette sleeve.

To obviate the afore-mentioned drawbacks. European Pat. No. EP-A-123 150 proposes a tobacco product for the personal preparation of cigarettes by the consumer, which is characterised by a pre-fabricated product, which is not smokeable as such, in the form of a tobacco cartridge prefabricated in a factory, consisting of a rod sheath open at the end face and adapted by its diameter to the cigarette paper sleeve of the finished cigarette and of a rod-like tobacco filling respectively corresponding to a cigarette portion, which can be transferred by an associated piston adapted to the inner diameter of the rod sheath, from the rod sheath into an empty cigarette paper sleeve. This tobacco product is suitable both for use in conjunction with conventional personal filling cigarette sleeves as well as in conjunction with conventional personal rolling cigarette paper pieces. According to the basic idea of this proposal, the consumer has an exactly measured quantity of tobacco in the form of a cigarette tobacco cartridge, corresponding to the filling quantity of a conventional industrial consumer cigarette. The tobacco filling of the cartridge can be transferred in a simple manner into a preformed cigarette sleeve of commercially available type or into a cigarette sleeve stuck together from a small piece of individual rolling cigarette paper.

Although the last-mentioned proposal is quite a considerable improvement with respect to the afore-mentioned prior art, it should not be overlooked that the tobacco cartridge comprises a wrapping, namely a rod sheath, of non-smokeable material. As regards the end product, namely the "cigarette", the rod sheath represents a superfluous aid which can only be used once. Furthermore, in the last-mentioned proposal, further aids are required for transferring the pre-portioned tobacco supply from the rod sheath into the cigarette paper sleeve, namely a loose tobacco transfer rod which can be operated hands off. The operation of the latter without further aids for introducing the filled tobacco cartridge into the empty cigarette paper sleeve and for fixing the rod sheath of the tobacco cartridge at the time of transfer of the tobacco supply, must create the greatest difficulties even for persons accustomed to preparing their own cigarettes. Various means or applicances for transferring the tobacco from the rod sheath into a cigarette paper sleeve are proposed in German Pat. No. DE-B-33 43 402 and European Pat. No. EP-A-84 111 150.3, in order to obviate these operating difficulties. However, lastly, even with this system for the personal preparation of the cigarette, one is dependant on additional aids.

German Pat. No. EP-A-155 514, which is attributed to the Applicant, proposes for the first time a tobacco product which allows personal preparation of cigarettes without aids, such as a tobacco transfer rod or the like and with which there is also no longer a rod sheath to be thrown away. This tobacco product consists of an inherently stable tobacco portion adapted to the tobacco filling of a finished cigarette and the surface of which is formed from a wrapping of completely smokeable material, the surface being so permeable to air that the tobacco portion as such cannot be smoked and is only smokeable after tight wrapping of its surface with cigarette paper or the like. A tobacco product constructed in a similar manner is proposed by EP-A-178 605, in which case according to a preferred embodiment, the diameter of the tobacco portion is slightly smaller than the inner diameter of the cigarette paper sleeve of the finished cigarette, in order to facilitate the introduction of the tobacco portion into the pre-formed cigarette paper sleeve. However, in order that the tobacco portion bears in a tight manner against the cigarette paper, for smoking, the diameter of the tobacco portion must be increased by the user by subsequent mechanical manipulation of the tobacco portion. The patent discloses manually breaking the wrapping of the tobacco portion after insertion in the cigarette paper sleeve. The wrapping of the tobacco portion or the rod sheath of the same is preferably provided with perforations, which extends over the axial length of the tobacco portion along a helix and which—in conjunction with the thinness of the rod sheath material—facilitates breaking of the wrapping with the desired variability of diameter by movement of the tobacco portion in opposition to the direction of rotation of the perforation helix. This type of rod sheath perforation should also facilitate a reduction of the diameter of the tobacco portion, in that one twists the latter in the direction of rotation of the perforation helix. However, this system requires instruction and a not inconsiderable skill because twisting of the tobacco portion requires that the tobacco portion be located with one end outside the cigarette paper sleeve, so that it can be gripped between thumb and forefinger. The opposite end of the tobacco portion located in the cigarette paper sleeve must likewise be held between the thumb and forefinger of the user's other hand during the twisting. In this system production of visible pressure points on the cigarette paper sleeve cannot be avoided. In the case of unskilled operation, the danger exists that the cigarette paper sleeve may break open and thus the cigarette is completely unsmokeable. It is also conceivable that the end of the tobacco portion projecting from the cigarette paper sleeve is broken open under radial expansion so that it can no longer be completely inserted in the cigarette paper sleeve without destroying the same at the particularly fragile insertion end. The reduction of diameter also proposed in European Pat. No. EP-A-178 605, with twisting of the tobacco portion, seems doubtful as regards its feasibility, since this necessitates the maintenance of the desired deformation of the tobacco portion for the purpose of insertion in a pre-formed cigarette paper sleeve. This requirement thus contradicts the subsequently desired radial expansion of the tobacco portion by inverse manipulation of the latter by the user. In all, the variability of diameter of the tobacco portion by mechanical manipulation of the latter by the user proposed in European Pat. No. EP-A-178 605 proves extremely difficult and not easy to carry out; in any case, it requires considerable dexterity on the part of the user.

SUMMARY OF THE PRESENT INVENTION

It is the object of the invention to provide a tobacco product of the type under consideration, which can be placed very easily within a cover such as the wrapping of cigarette paper or similar material which can be smoked or on which it is possible to draw. The tobacco portion has a smaller diameter than the cigarette paper wrapper and the tight bearing of the tobacco against the wrapper of cigarette paper or the like, which is necessary for smoking the end product, namely a "cigarette" is achieved in accordance with this invention without subsequent manipulation of the tobacco portion and/or of the wrapping of cigarette paper or the like by the user.

More particularly, the tobacco product for the personal preparation of a cigarette includes an inherently stable tobacco portion consisting of a completely smokeable material. An outer wrapping which is permeable to air forms a part of the tobacco portion such that an airtight outer cover is required to smoke the tobacco portion. The diameter of the wrapped tobacco portion is generally less than the inner diameter of the outer cover. The tobacco portion is formed of a smokeable material which automatically expands, thereby increasing the diameter of the tobacco portion to move into tight engagement with the outer cover at least in the region of the glowing area at the end of the cigarette during smoking the cigarette. The tobacco portion may alternatively be wrapped with the conventional outer cigarette paper by the smoker. The outer wrapping may be a smokeable fixative material which holds the tobacco particles together and defines an outer surface which is permeable to air. The heat created by smoking automatically produces the radial expansion of the tubular portion into a tight engagement against the cover to permit the continued smoking of the cigarette. The wrapping may be formed with an axial breaking area extending at least over part of the length of said tobacco portion. The breaking area is responsive to heat and/or moisture emanating from the glowing area of the finished cigarette and the radial expansion of the tobacco portion to break open the wrapping with the tobacco portion tightly engaging the cover. The tobacco portion and cover may be structured and arranged with engaging surfaces such that said tobacco portions is movable into the cover with the surfaces securely engaged and without significant openings between the tobacco portion and cover.

The construction of the tobacco product according to the invention is characterised by the fact that nothing is required of the user anymore. No separate action by the user is required for the individual preparation of a cigarette with the exception of placing the tobacco product within a wrapping of cigarette paper or similar material. Ensuring that the tobacco bears in a tight manner against the wrapping of cigarette paper or the like takes place automatically according to the invention. A subsequent mechanical action on the tobacco product by the user, as proposed in EP-A-178 605, is no longer necessary.

Advantageous details or embodiments of the basic idea according to the invention are described and the subject defined as set forth in the dependent claims. The method for producing a cigarette using tobacco products constructed according to the invention.

BRIEF DESCRIPTION OF THE DRAWINGS

Embodiments of tobacco products constructed according to the invention are described in detail hereafter with reference to the accompanying drawings, in which.

DESCRIPTION OF THE ILLUSTRATED EMBODIMENT

Figure 1:
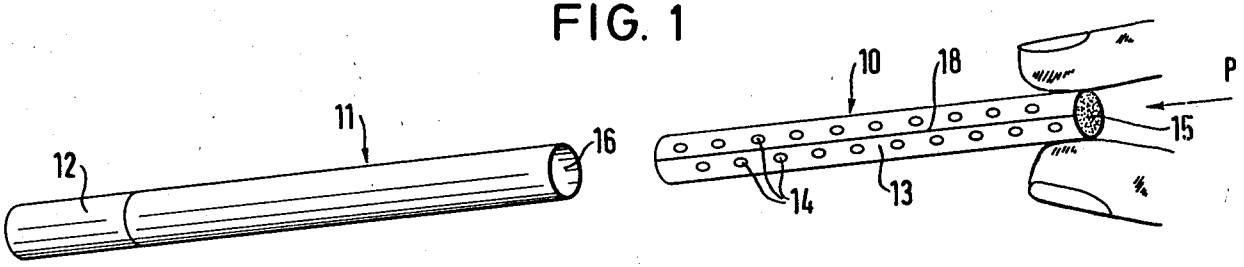
FIG. 1 shows in exploded, perspective view, a system for the personal preparation of a cigarette according to a preferred embodiment of the invention for use in conjunction with prefabricated cigarette paper sleeves of the conventional type used by persons filling their own cigarettes.
Figure 2:
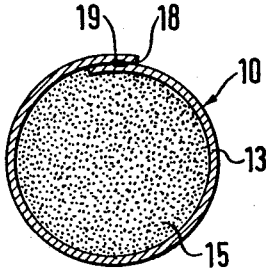
FIG. 2 is a cross-section through a tobacco portion according to FIG. 1, to an enlarged scale.

FIG. 1 shows an industrially prefabricated, inherently stable tobacco portion 10 in conjunction with a likewise industrially prefabricated cigarette paper sleeve 11 with a filter 12 of the conventional type used by persons filling their own cigarettes. The essential component of the system illustrated is the inherently stable tobacco portion, which cannot be smoked outside the cigarette paper sleeve 11, but otherwise consists completely of smokeable material. In the embodiment according to FIGS. 1 and 2 illustrated by way of example, the tobacco portion 10 consists of a rod sheath 13 of thin tobacco film material or cigarette paper dyed the colour of tobacco, which is provided with perforations 14. According to FIG. 1, the perforations extend over the entire length of the tobacco portion 10. The perforations 14 are preferably distributed approximately uniformly over the length and circumference of the tobacco protion 10. Instead of perforations, a porous wrapping material may also be used as the rod sheath 13. The rod sheath 13 contains a rod-like tobacco filling 15 introduced at the manufacturing point. The tobacco filling in the rod sheath 13 is packed approximately as densely, preferably slightly more densely in the radial direction, as in an industrially produced cigarette. The tobacco portion 10 has a length which corresponds approximately to the length of the tobacco receiving space 16 of a commercially available cigarette paper sleeve 11. The outer diameter of the tobacco portion is slightly smaller than the inner diameter of the cigarette paper sleeve 11, so that it can be guided or introduced without problems into the cigarette paper sleeve 11. In this case, the diameter of the tobacco portion 10 is such that the tobacco portion 10 can also be introduced with clearance, i.e. without problems, into a cigarette paper sleeve produced with an undersized diameter. As regards their diameter, cigarette paper sleeves which are presently available have tolerances within the order of magnitude of 1/10–2/10 mm; accordingly, the diameter of the tobacco portion 10 is designed so that it can be introduced in a problem-free manner without aids into a cigarette paper sleeve, which has the maximum diameter minus tolerance as regards diameter. Irrespective of this, the tobacco filling 15 of each tobacco portion 10 corresponds as regards the quantity to the tight packing of the cigarette paper sleeve 11 desired for the finished cigarettes and indeed—as illustrated—according to cigarette normally produced in a factory. The cross-section of the tobacco portion 10 is preferably constructed to be approximately circular over the entire length so that it matches the free cross-section of the cigarette paper sleeve 11.

Figure 3:
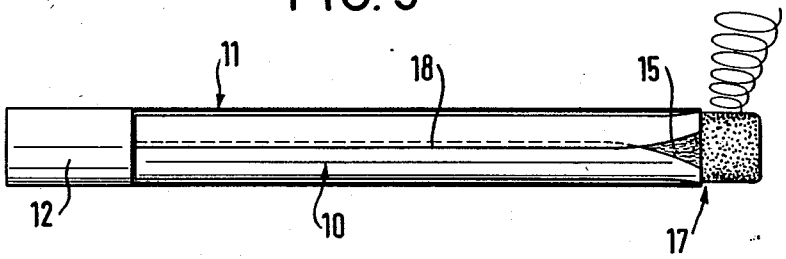
FIG. 3 is a diagrammatic longitudinal section through a cigarette, which is produced using a tobacco product constructed according to the invention and illustrating the automatic adaptation of the diameter of the tobacco portion inserted in the cigarette paper sleeve to the internal diameter of the cigarette paper sleeve in the region of the glowing area.

In order that it is ensured that the tobacco portion 10 or tobacco filling 15 bears in a tight manner or fully against the inner side of the cigarette paper sleeve 11. The tobacco portion is formed such that when used, its diameter increases automatically with radial expansion and accordingly bears tightly against the cigarette paper and indeed at least in the region of the glowing area 17 and progressively with the latter as the cigarette produced is smoked. There are several possibilities described for accomplishing this expansion:

One possibility consists in that when constructing the wrapping or cover of the tobacco filling 15 to form a rod sheath, the cover has a connecting seam of 18 with overlapping edges which are connected by a thermoplastic adhesive. The adhesive is harmless as regards food technology and opens at least in the region of the relatively hot glowing area 17 at the time of smoking of cigarettes, and progressively with the glowing area. The tobacco portion 10 or its tobacco filling 15 can therefore expand radially outwards, thus bearing in a tight manner or engagement against the cigarette paper. The cigarette is consequently able to be smoked when used and initially at the time of lighting or with the first puff the expansion occurs, without the user having to act in any way (mechanically) on the cigarette portion 10. In FIG. 3, the opening of the connecting seam 18 in the region of the glowing area 17 is illustrated diagrammatically. Naturally it is also conceivable that when used, for example with the first puff, the longitudinal seam 18 opens over its full length. This depends in part on the consistency of the adhesive used.

The afore-described embodiment is most simple as regards production technology. The tobacco portions 10 may be manufactured on a conventional cigarette production machine. It is solely necessary to use the afore-said adhesive, in order to achieve the desired effect of radial expansion when the cigarette is used.

Opening of the adhesive seam 19 may also occur due to the moisture liberated at the time of smoking, which moisture is inherent in the tobacco filling 15.

Thus, on account of the action of heat or moisture, the radial "pre-tension" of the tobacco portion 10 should be eliminated, so that the tobacco portion 10 or its tobacco filling 15 bears in a tight manner against the inner surface of the wrapping of cigarette paper.

Another possibility of achieving the desired increase in diameter of the tobacco portion when in use, consists in the provision of a pre-determined breaking area or point, preferably a pre-determined breaking line, which extends over the entire length of the tobacco portion 10 and which breaks open due to the moisture liberated when the finished cigarette is used or due to the heat produced during the use of the finished cigarette. The pre-determined breaking line is preferably characterised by a weakening of the material of the rod sheath 13. It may also be formed by a particularly intensive perforation, that is to say the close arrangement of perforation openings along a pre-determined line.

When using a tobacco portion, which is held together by a smokeable fixative such as the previously described sheath, with the formation of an inherently stable tobacco rod, in order to achieve the automatic increase in diameter at the time of use is achieved by use of a fixative which brings about a radial expansion of the tobacco rod in response to heat and/or moisture which is released, so that the tobacco bears in a tight manner against the cigarette paper. The expansion of the tobacco rod may take place in the region of the glowing area and at the time of smoking of the cigarette, progressively with the expansion occuring with the latter. The tobacco rod is preferably compressed radially, in which case it is held in this compressed state by the fixative. Under the action of heat and/or moisture which is released at the time of lighting the cigarette or of the first puff, the fixative is no longer be capable of holding the tobacco rod together in the radial direction, so that the radial compression or pre-tension imparted is eliminated and the tobacco expands as described above.

Figure 4:
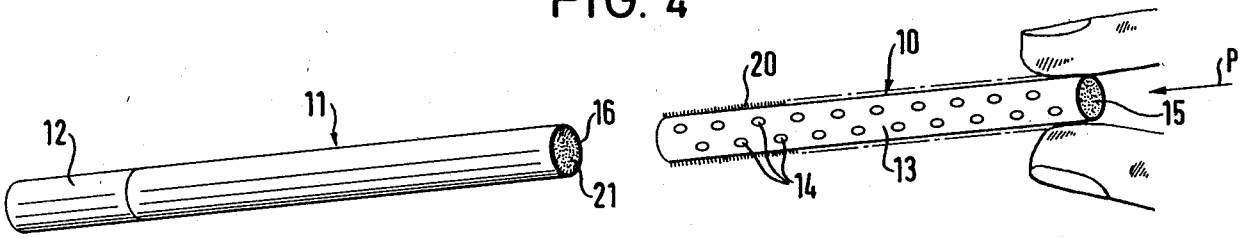
FIG. 4 shows in exploded perspective view a system for the personal preparation of a cigarette according to another embodiment of the invention, for use in conjunction with prefabricated cigarette paper sleeves of the conventional type used by persons filling their own cigarettes.
Figure 5:
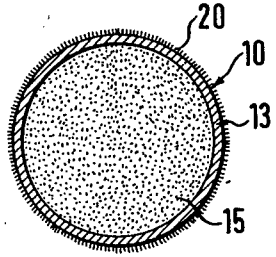
FIG. 5 is a cross-section through a tobacco portion according to FIG. 4, to an enlarged scale.

According to a further embodiment, the surface of the tobacco portion 10 or rod sheath 13 and/or the inner surface of the wrapping 11 of cigarette paper is constructed in the form of hide, as shown in in FIGS. 4 and 5. The hide-like structures 20 of the tobacco portion 10 and 21 of the cigarette paper sleeve 11 are constructed so that on the one hand they do not impede the insertion of the tobacco portion 10 into the prefabricated cigarette paper sleeve 11, and on the other hand the tobacco portion 10 is held securely in the tobacco-receiving area 16 of the cigarette paper sleeve 10. The hide-like structure 21 on the inner surface of the cigarette paper sleeve 11 is thus directed towards the filter member 12, whereas the direction of the hide-like structure 20 on the surface of the tobacco portion 10 is exactly the opposite when inserting the latter into the tobacco-receiving area 16 of the cigarette paper sleeve 11 (see arrow P). The hide-like structure 20 and/or 21 causes adequate filling-out of possible gaps between the tobacco portion 10 on the one hand and cigarette paper sleeve 11 on the other hand so that the personally prepared cigarette can be smoked without problems and without irregular burning of the cigarette paper sleeve. Suction takes place over the entire cross-section of the cigarette paper sleeve 11 in an approximately uniform manner. Simultaneously, secure holding of the tobacco portion 10 within the cigarette paper sleeve 11 is also ensured if the diameter of the cigarette paper sleeve has a maximum plus-tolerance.

In order to save the user from paying attention to the fact that the hide-like structure 20 on the surface of the tobacco portion 10, at the time of insertion into the tobacco-receiving area 16 of the cigarette paper sleeve 11, is directed as described above, the direction of the hide-like structure 20, and particularly the surface fibres or hairs, is approximately at right angles to the surface. Then the tobacco portion 10 can always be introduced without problems into the tobacco-receiving area 16 of the cigarette paper sleeve 11 with filling the possible gaps, in particular annular gaps, between the tobacco portion 10 and the cigarette paper sleeve 11. At the same time, the adequate securement and retention of the tobacco portion 10 in the tobacco-receiving area 16 of the cigarette paper sleeve 11 is established, even if no hide-like structure 21 is provided on the inner surface of the cigarette paper sleeve 11. The hair-like fibres forming the hide-like structure 20 or 21 have a length of approximately 0.1 to approximately 0.3 mm. Thus the afore-mentioned plus/minus tolerances in the diameter of conventional cigarette paper sleeves 11 can be compensated for without problems. The construction of the tobacco portion 10 and/or cigarette paper sleeve 11 as described above may also be combined with previously described structure for increasing the diameter of the tobacco portion, as described in more detail hereafter. Furthermore, solely the inner surface of the cigarette paper sleeve 11 may be provided with a hide-like structure 21. The described hide-like structures 20 or 21 give the impression of velvet. The hide-like structure 20 or 21 may also be applied after forming of the tobacco portion or sleeve and to the corresponding surface particular sprayed on the corresponding surface. The the hide-like structures 20 or 21 produces a complete filling-out of the tobacco-receiving area 16 of a cigarette paper sleeve 11 even if the diameter of the tobacco portion 10 is appreciably smaller than the inner diameter of the cigarette paper sleeve 11.

Figure 6:
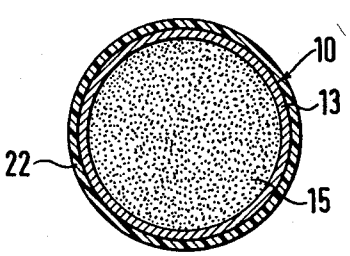
FIG. 6 is a cross-section through a further embodiment of a tobacco portion, to an enlarged scale.

In the embodiment according to FIG. 6, the rod sheath 13 of the tobacco portion 10 is provided with an elastically yielding coating 22 of smokeable material, which naturally includes the same perforations as the rod sheath 13. In the same way as the afore-described hide-like structures 20, 21, this elastically yielding coating allows complete filling-up of the tobacco-receiving area 16 of the cigarette paper sleeve 11 even with appreciable tolerances of diameter of the tobacco product 10 on the one hand and cigarette paper 11 on the other hand. In a development of this embodiment it is also conceivable to produce the rod sheath 13 completely from an elastically yielding material, in which case before use, the elastically yielding coating 22 or the rod sheath 13 made from elastically yielding material is compressed radially by an outer packaging, in particular a wrapping of cellophane or similar material. The compression is released by removing the outer packaging with the radial movement preferably including a time-lag so that after introduction into the tobacco-receiving area 16 of the cigarette paper sleeve 11, the tobacco portion 10 bears in a tight manner against the inner surface of the cigarette paper sleeve 11 as the result of the radial expansion of the coating 22 or of the rod sheath 13 made from elastically yielding material.

Figure 8:
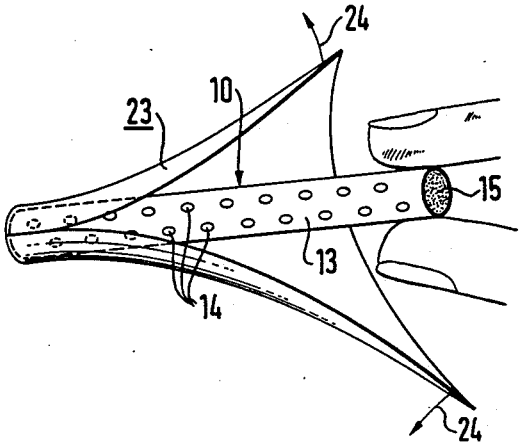
FIG. 8 shows the tobacco portion according to FIG. 7 in perspective view and showing the removal of an outer packaging, which keeps the tobacco portion compressed in the radial direction.
Figure 7:
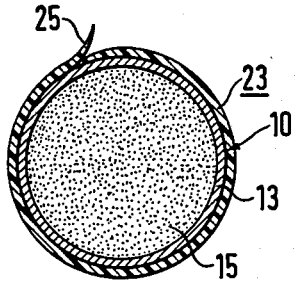
FIG. 7 is a cross-section through a further embodiment of a tobacco portion prepared according to the invention, to an enlarged scale.

FIGS. 7 and 8 show the application of an outer packaging in the form of a wrapping 23 of cellophane or the like, which keeps the tobacco portion radially compressed. After removing the wrapping 23 (see arrow 24 in FIG. 8), the tobacco portion 10 should expand radially, preferably with a short time lag, so that a tight abutment within the cigarette paper sleeve 11 is guaranteed, and indeed even if the diameter of the cigarette paper sleeve 11 is appreciably greater than the diameter of the radially compressed tobacco portion 10.

It is also conceivable to establish radial compression of the tobacco portion 10 within a box-like packaging, without each individual tobacco portion 10 being wrapped separately, as illustrated in FIGS. 7 and 8. Then it is solely necessary to remove the tobacco portion 10 from the box-like packaging and to insert it in the tobacco-receiving space 16 of a cigarette paper sleeve 11. With a correspondingly chosen time lag for the radial expansion, a firm or tight bearing and engagement of the tobacco portion 10 against the inner surface of the cigarette paper sleeve 11 is achieved.

For the easier removal of the wrapping 23, the latter has a projecting tab 25, as illustrated in FIG. 7.

The afore-described tobacco product is also suitable for the personal preparation of a cigarette using self-rolling cigarette paper, in particular cigarette paper pieces. In this system, the cigarette paper or cigarette paper piece is wrapped around the tobacco portion and secured along a longitudinal seam in manner known per se.

Instead of providing the surfaces of the tobacco product and cigarette paper sleeve with a hide-like structure (see FIGS. 4 and 5), the facing surfaces may also have a scale-like structure and/or be provided with annular, inter-engaging projections so that the tobacco portion 10 can be inserted in an unimpeded manner into the wrapping of cigarette paper, and the tobacco portion 10 is also held reliably within the wrapping of cigarette paper with a simultaneous sealing of gaps or channels between the tobacco portion and wrapping.

All the features disclosed in the documents are claimed as essential to the invention, in so far as they are novel individually or in combination with respect to the prior art.

We claim:

1. A tobacco product for the personal preparation of a cigarette including an inherently stable tobacco portion (10) filling an outer wrapping (13) consisting of a completely smokeable material, said wrapping being permeable to air such that smoking the tobacco portion (10) requires an airtight outer cover (11), the diameter of the wrapped tobacco portion (10, 13) being less than the inner diameter of the outer covering, comprising said tobacco portion (10) including smokeable material automatically expanding and thereby increasing the diameter of the tobacco portion to move into tight engagement with said cover at least in the region of the glowing area (17) as the result of smoking the cigarette.

2. The tobacco product of claim 1, wherein said tobacco portion (10) comprises a radially compressed tobacco so that in smoking the tobacco portion (10) expands radially outward within the cover without particular action by the user.

3. The tobacco product of claim 1, wherein said wrapping is a rod sheath (13) having a connecting seam (18) having overlapping portions, thermoplastic adhesive means between said overlapping portions joins said overlapping portions, said connecting seam being responsive to the smoking of the cigarette at least in the region of said glowing area (17) to open said tobacco portion (10) including a tobacco filling (15) expanding radially outwards into tight bearing engagement against the cover.

4. The tobacco product of claim 1 including an outer storage package, wherein said tobacco portion (10) is radially compressed and stored in a compressed state within said outer storage package, said tobacco portion expanding automatically radially outwards with a corresponding increase in diameter substantially upon removal from said package.

5. The tobacco product of claim 1, wherein said tobacco portion (10) is placed under stress to establish said lesser diameter and said tobacco portion responding to heat from said glowing area (17) of the finished cigarette to remove said stress and expand said tobacco portion.

6. The tobacco product of claim 1, wherein said wrapping has at least one pre-determined breaking area extending over part of the length of said tobacco portion, said breaking area being responsive to heat emanating from said glowing area (17) of the finished cigarette and said radial expansion of the tobacco portion (10) caused thereby breaking so that said tobacco portion (10) is adapted to bear in a tight engagement against the cover.

7. The tobacco product of claim 6, wherein said predetermined breaking area is responsive to moisture to open, and said tobacco portion includes moisture released at the time of smoking of the finished cigarette.

8. The tobacco product of claim 1, wherein said tobacco portion includes moisture and said wrapping is a moisture-sensitive material and breaks open due to said moisture being released in response to smoking of said finished cigarette.

9. The tobacco product of claim 1, wherein the initial smoking of the finished cigarette automatically establishes and increases in diameter the tobacco portion (10).

10. The tobacco portion of claim 1 wherein said cigarette paper (11) contracts radially and bears tightly against the surface of the tobacco portion (10).

11. A tobacco product for the personal preparation of a cigarette, in particular a filter cigarette, consisting of an inherently stable tobacco portion (10) including tobacco particles defining the tobacco filling of a finished cigarette, comprising a smokeable fixative material holding of said tobacco particles together and defining an outer surface permeable to air and whereby said tobacco portion (10) can only be smoked after tight wrapping with a cover of cigarette paper or the like, a cover adapted to enclose said tobacco portion, said tobacco portion (10) being responsive to heat to increase automatically with radial expansion into a tight engagement against the cover and responsive at least in the region of the glowing area (17) as the cigarette is smoked to at least progressively expand.

12. The tobacco product of claim 11, wherein said tobacco portion includes moisture, radial expansion of the tobacco portion (10) takes place automatically in response to the action of said heat and moisture in said tobacco which is liberated at the time of smoking.

13. The tobacco product of claim 12 wherein the surface of the tobacco portion (10) and/or the inner face of the wrapping of cigarette paper or the like are constructed in the form of hide, the hide-like surface structure (20, 21) perferably being directed in particular so that on the one hand it does not impede the insertion of the tobacco (10) into a pre-formed cigarette paper sleeve (11), on the other hand it holds the tobacco portion (10) securely within the cigarette paper sleeve (11) whilst filling any possible gaps between the latter and the tobacco portion.

14. The tobacco product of claim 11 wherein said cover is a preformed tubular member, said tobacco portion (10) and cover are structured and arranged with said tobacco portion (10) movable into the cover and said tobacco portion (10) securely engages the cover without significant openings between said tobacco portion and said cover.

15. The tobacco product of claim 11 wherein the surface of the tobacco portion (10) is prepared with chemical additives, such as whitening agents and incendiary agents in the form of a liquor so that during smoking of the cigarette or burning of the tobacco portion (10), the latter fans out at least in the region of the glowing area (17) and indeed progressively with the latter with the tobacco portion bearing in a corresponding tight manner against the cigarette paper.

* * * * *